United States Patent [19]

Miyahara et al.

[11] Patent Number: 4,977,910

[45] Date of Patent: Dec. 18, 1990

[54] CLEANING METHOD FOR APPARATUS

[75] Inventors: Shuji Miyahara; Harumi Kimuro, both of Yokohama; Saburo Yamashita, Ayase, all of Japan

[73] Assignee: Shikawajima-Harima Jukogyo Kabushi Kaisha, Japan

[21] Appl. No.: 651,267

[22] Filed: Sep. 17, 1984

[30] Foreign Application Priority Data

Sep. 19, 1983 [JP] Japan ..... 58-172732

[51] Int. Cl.[5] ..... B01B 7/00

[52] U.S. Cl. ..... 134/7; 51/320; 51/307; 51/410

[58] Field of Search ..... 134/7; 51/320, 307, 51/410

[56] References Cited

U.S. PATENT DOCUMENTS 2,699,403 1/1955 Courts ..... 134/7
3,702,519 11/1972 Rice et al. ..... 51/320

FOREIGN PATENT DOCUMENTS 2475425 8/1981 France ..... 51/320
1397102 6/1975 United Kingdom ..... 51/320

*Primary Examiner*—Curtis R. Davis

[57] ABSTRACT

Part of liquefied carbon dioxide is subjected to adiabatic expansion so that the remainder becomes snow-like dry ice due to heat of vaporization and heat of sublimation while a liquid is being sprayed to produce snow-like frozen liquid. The snow-like dry ice and the snow-like frozen liquid are mixed and the mixture is compressed and pelletized to produce hard particles each of which consists of a particle of snow-like dry ice coated with snow-like frozen liquid. Thus obtained particles are projected by compressed air or water under high pressure against an object to be cleaned. Wet type abrasive blasting can be effected because when the particles are projected against the object, the frozen liquid coating the surfaces of snow-like dry-ice particles is broken.

2 Claims, 2 Drawing Sheets

CLEANING METHOD FOR APPARATUS

BACKGROUND OF THE INVENTION

The present invention relates to a cleaning method and apparatus in which composite particles consisting of snowlike ice powder and snow-like dry ice are projected against an object to be cleaned.

There are two typical cleaning methods of this kind; that is, (1) sand blasting method in which sand is projected under high pressure through a nozzle against an object to be cleaned and (2) a dry-ice blasting method in which large lumps of dry ice are broken into finely divided particles and such dry-ice particles are projected against an object to be cleaned.

In the sand blasting method, dust or the like is scattered too much. Especially when the sand blasting method is employed for cleaning of various devices and equipment in a nuclear power plant, there arises a problem that dust including radioactive substances is scattered and discharged into the atmosphere.

In the dry-ice blasting method, when relatively large lumps of dry ice are broken into finely divided dry-ice particles, dry-ice particles tend to become powder. As a result, the yield of the dry ice used is poor and the dry-ice blasting method becomes very expensive. Furthermore, there is a problem that dry-ice particles are vaporized during the cleaning operation so that an object being cleaned cannot be seen. That is, the working conditions are adversely affected.

The present invention was made to overcome the above and other problems and has its primary object to project particles whose surfaces are harder than those of dry-ice particles, thereby improving the cleaning efficiency. To the above and other ends, according to the present invention, snow-like solids (to be called "snow dry ice") are produced from liquefied carbon dioxide and a liquid is sprayed over the snow dry ice, whereby the snow mixture consisting of dry ice and frozen liquid is produced. The snow mixture is compressed in the form of particles or chalk-like elongated pieces and charged into a projector so as to be projected against an object by compressed air or water under high pressure. The liquid is frozen over the surface of each dry-ice particles so that the surfaces of the composite particles become very hard so that the blasting efficiency can be improved. Furthermore the ice surfaces are broken when the composite particles strike against an object to be cleaned so that a wet type blasting can be carried out. As a result, the phenomenon that an object becomes invisible due to the vaporization of dry-ice particles can be avoided.

The above and other objects, effects, features and advantages of the present invention will become more apparent from the following description of a preferred embodiment of the present invention taken in conjunction with the accompanying drawings.

DESCRIPTION OF THE PREFERRED EMBODIMENT

According to the present invention, prior to production of dry-ice particles, part of liquefied carbon dioxide ($LCO_2$) is subjected to adiabatic expansion so that the remainder becomes snow dry ice due to heat of vaporization and heat of sublimation. Then, a liquid is sprayed to produce snow-like frozen liquid. Snow-like frozen liquid and snow dry ice are mixed to prepare snow mixture and the snow mixture is charged into a pelletizer to produce particles of snow mixture. The composite particles consisting of dry ice and frozen liquid are forcedly projected as abrasive against an object to be cleaned.

Figure 1:
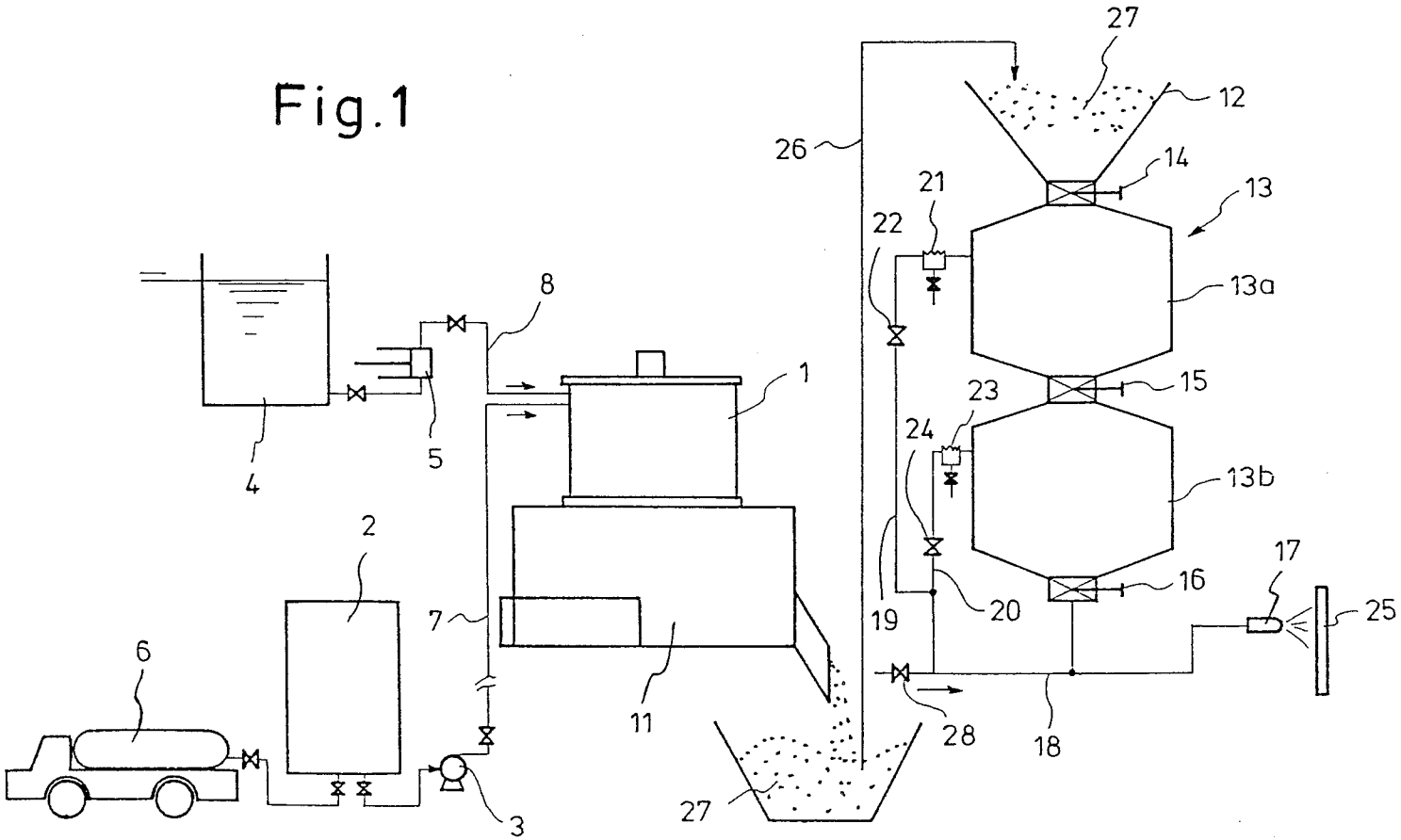
FIG. 1 shows a preferred embodiment of a cleaning apparatus in accordance with the present invention.

Referring to FIG. 1, $CO_2$ gas is compressed at low temperature to produce $LCO_2$. $LCO_2$ is transported by a tank truck 6 and stored in a storage tank 2. $LCO_2$ stored in the storage tank 2 is transported through a pump 3 to a snow-mixture making device 1 so as to produce snow dry ice. Water stored in a water storage tank 4 is charged under high pressure by a high pressure pump 5 into the snow-mixture making device 1 so as to produce snow-like ice powder (to be called "snow ice"). Snow dry ice and snow ice are mixed.

Figure 2:
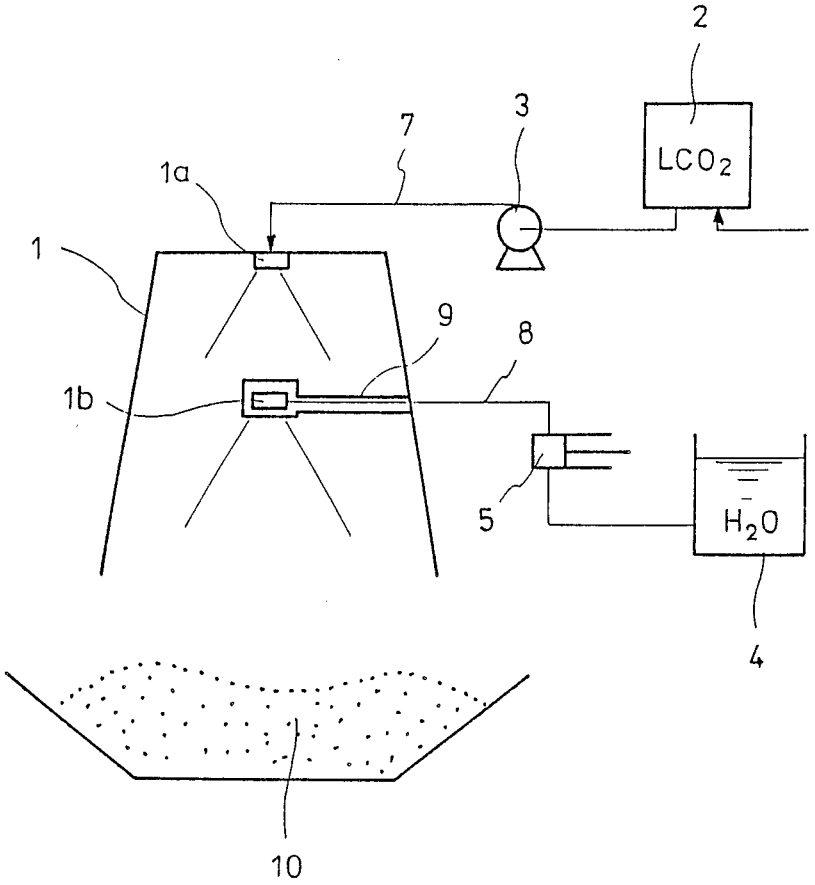
FIG. 2 is a sectional view of an example of a snow-mixture making device.

The snow-mixture making device 1 is exemplarily shown in detail in FIG. 2. A spray nozzle la for spraying $LCO_2$ like mist is disposed at the top of the snow-mixture making device 1 and is directed downwardly. Another spray nozzle 1*b* for spraying water downwardly at a predetermined rate is disposed below the spray nozzle 1*a*. The spray nozzle 1*a* is communicated through a hose 7 with the pump 3 while the water spray nozzle 1*b* is communicated through a hose 8 with the high pressure pump 5. A part of the hose 8 which is disposed within the snow-mixture making device 1 is applied with a heat insulating material 9 and is heated by a heater (not shown) so that the water is prevented from being frozen within the hose 8 in the snow-mixture making device 1.

The snow-mixture making device 1 is connected to a pelletizer 11 which compresses the snow mixture 10 produced by the snow-mixture making device 1 into particles or chalk-like elongated pieces 27 consisting of the mixture of dry ice and ice.

A variety of pelletizers 11 are available. In one pelletizer, the mixture consisting of snow dry ice and snow ice is compressed with a press mold so that many particles are produced. In another pelletizer, holes are formed through the cylindrical wall of an outer barrel so that the snow mixture charged into the space between the outer barrel and an inner rotating barrel is extruded through the holes, whereby the snow mixture is pelletized.

Thus obtained snow-mixture particles are projected as abrasive against an object to be cleaned by means of a projecting device. The projecting device has a projector 13 and a hopper 12 which is charged with snow-mixture particles and is communicated with the top of the projector 13 through a solenoid-controlled valve 14. The projector 13 comprises an upper vessel 13*a* and a lower vessel 13*b* and a solenoid-controlled valve 15 is interposed between the upper and lower vessels 13*a* and 13*b* while another solenoid-controlled valve 16 is attached to the bottom of the lower vessel 13*b*. The upper vessel 13*a* is communicated with an air line 19 having a defrosting device 21 and a valve 22 while the lower vessel 13*b* is communicated with an air line 20 having a defrosting device 23 and a valve 24. The bottom of the lower vessel 13*b* is communicated through the valve 16 with a compressed air line 18 and the snow-mixture particles consisting of snow dry ice and snow ice are projected through a nozzle 17 by the compressed air against an object 25 on a table (not shown). Reference numeral 26 denotes a conveyor for transporting particles 27 produced by the pelletizer 11 to the hopper 12; and 28, a valve.

In order to produce abrasive particles, liquefied $CO_2$ ($LCO_2$) is transported by the pump 3 from the storage tank 2 to the snow-mixture making device 1 and is sprayed through the spray nozzle 1*a*. Part of $LCO_2$ is subject to adiabatic expansion so that the remainder becomes snow dry ice with a temperature of about −80° C. due to heat of vaporization and heat of sublimation. In this case, according to the present invention, water is also sprayed. More particularly, water ($H_2O$) supplied from the water storage tank 4 is increased in pressure by the high pressure pump 5 and then sprayed through the water spray nozzle lb within the snow-mixture making device 1. The sprayed water absorbs negative heat produced when snow dry ice is produced and becomes snow-like ice powder. The snow-like ice powder is then mixed with snow dry ice, whereby snow mixture consisting of $CO_2$ and $H_2O$ is produced. The mixture 10 produced by the snow-mixture making device 1 is charged into the compression or extrusion pelletizer 11 so that chalk-like or particle-like mixture can be obtained.

Thus obtained particles of the mixture consisting of dry ice and ice have a structure in which the surface of a dry-ice particle of about −80° C. is coated with ice. The surfaces of snow-mixture particles are glossy and hard. Even when the temperature is higher than about −80° C. and ice coating the surfaces of snow-dry-ice particles do not melt, dry ice will not melt and not vaporize. As a result, the snow-mixture particles are not surrounded with mist and the consumption of dry ice can be avoided.

The particles 27 whose surfaces are glossy and hard are charged by the conveyor 26 into the hopper 12 and then into the projecting device 13. As described above, the projecting device 13 comprises the upper and lower vessels 13*a* and 13*b* so that the particles each of which comprises a dry-ice particle coated with ice are transported in a manner to be described below. In order to carge the particles 27 from the hopper 12 into the upper vessel 13*a*, the solenoid-controlled valve 15 and the valve 22 are closed while the solenoid-controlled valve 14 is opened. Thereafter the solenoid-controlled valve 14 is closed while the solenoid-controlled valve 15 and the valve 22 are opened so that the particles 27 are charged from the upper vessel 13*a* into the lower vessel 13*b*. Next the solenoid-controlled valve 16 and the valve 28 are opened so that the particles 27 are continuously supplied to the projection nozzle 17. The above-described steps are repleated so that the particles 27 are charged into the projecting device 13.

The particles 27 are sprayed through the projection nozzle 17 against the object 25, whereby cleaning is effected.

As described above, the particles 27 which are projected against the object 25 through the projection nozzle 17 has a structure that each dry-ice particle is coated with ice. Therefore the particles 27 have surfaces harder than those of dry-ice particles so that the particles 27 can more effectively abrase the surfaces of the object 25. Furthermore when the abrasive particles in accordance with the present invention are projected against the object 25, part of ice coating the surfaces of the abrasive particles 27 is broken and becomes mist so that the wet type abrasive blasting can be carried out. In the case of the dry ice particles, they are vaporized when projected against an object so that the object becomes invisible; but according to the present invention such problem as described above can be solved. Moreover, unlike sand balsting, the scattering of dust can be prevented.

So far it has been described that the abrasive particles 27 are projected by the compressed air, but it is to be understood that they may be projected by water under high pressure. The projector 13 has been described as comprising two vessels 13*a* and 13*b*, but it is to be understood that the projector 13 comprises only one vessel. It has been also described that the abrasive particles 27 are produced by compressing or extruding the snow mixture consisting of snow dry ice and snow ice, the abrasive particles being in the form of chalk or particles; but it is to be understood that instead of water any suitable liquid can be used. When a process liquid is used, there is an advantage that no foreign matter is entrained in the process liquid. Furthermore, it is to be understood that various modifications may be made without leaving the true spirit of the present invention.

As is clear from the foregoing, according to the present invention, abrasive particles produced by compressing or extruding the snow mixture consisting of snow-like dry ice and snow-like frozen liquid are used so that the following effects, features and advantages can be obtained:

(i) Unlike sand balsting, no dust scattering occurs and unlike abrasive blasting using only dry-ice particles, visibility is not adversely affected by vaporization of dry ice. As a result, working conditions can be considerably improved.

(ii) Each abrasive particles is produced by compressing the mixture consisting of snow-like dry ice and snow-like frozen liquid so that it is very hard. As a result, as compared with the case in which only dry ice particles are used, an object to be cleaned can be more effectively and efficiently abrased. In other words, the efficiency of abrasive blasting can be remarkably improved.

(iii) In order to produce abrasive particles, liquefied carbon dioxide and a liquid are mixed at a suitable ratio. As a result, a required amount of snow mixture for pelletization can be produced as needs demand.

(iv) Generally, dry ice cannot be stored for a long time. According to the present invention, liquefied carbon dioxide is stored and, in use, part of liquefied carbon dioxide is vaporized so that the remainder becomes snow-like dry ice; in this case, liquid is sprayed so that the snow mixture is obtained. Thus, according to the present invention, the starting material for production of abrasive particles can be stored for a long time.

What is claimed is:

1. A method of cleaning the surface of an object comprising, subjecting liquified carbon dioxide to adiabatic expansion to produce snow-like dry ice particles;

simultaneously spraying water into said dry ice particles as they are produced to form a mixture of snow-like dry ice and snow-like frozen water particles;

pelletizing said mixture by compression to form hard composite abrasive particles thereof; and projecting in a fluid medium the pelletized particles so produced against an object to be cleaned.

2. A cleaning apparatus comprising a chamber for producing a mixture of snow-like dry ice and snow-like frozen water; means for atomizing liquified carbon dioxide within said chamber;

means for spraying water into said chamber below said atomizing means;

a compression pelletizer for receiving and compressing the mixture produced in said chamber into hard composite abrasive particles of dry ice and frozen water; and means for projecting said pelletized particles against an object to be cleaned.

* * * * *

UNITED STATES PATENT AND TRADEMARK OFFICE

CERTIFICATE OF CORRECTION

PATENT NO. : 4,977,910

DATED : December 18, 1990

INVENTOR(S) : Shuji Miyahara; Harumi Kimuro; and Saburo Yamashita

It is certified that error appears in the above-identified patent and that said Letters Patent is hereby corrected as shown below:

On the title page:

[73] Assignee: Ishikawajima-Harima Jukogyo Kabushiki Kaisha

Signed and Sealed this

Sixth Day of April, 1993

*Attest:*

STEPHEN G. KUNIN

*Attesting Officer*

*Acting Commissioner of Patents and Trademarks*